US007794109B2

(12) United States Patent
Miyasu et al.

(10) Patent No.: US 7,794,109 B2
(45) Date of Patent: Sep. 14, 2010

(54) LIGHT SOURCE APPARATUS

(75) Inventors: Katsuoki Miyasu, Hyogo (JP); Takehiko Iguchi, Hyogo (JP); Hitoshi Nakabayashi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 90 days.

(21) Appl. No.: 12/153,103

(22) Filed: May 14, 2008

(65) Prior Publication Data

US 2008/0304264 A1 Dec. 11, 2008

(30) Foreign Application Priority Data

Jun. 6, 2007 (JP) ..... 2007-150532

(51) Int. Cl.
*F21V 7/00* (2006.01)

(52) U.S. Cl. ..... 362/240; 362/302; 362/297; 362/298; 362/306

(58) Field of Classification Search ..... 362/297, 362/298, 302, 304, 306, 441
See application file for complete search history.

(56) References Cited

U.S. PATENT DOCUMENTS 6,123,429 A * 9/2000 Osawa ..... 359/868
6,338,564 B1 * 1/2002 Jordan et al. ..... 362/346
2004/0027836 A1 * 2/2004 Takada et al. ..... 362/539
2005/0248956 A1 * 11/2005 Iwasaki ..... 362/517

FOREIGN PATENT DOCUMENTS

| | | | |
|---|---|---|---|
| JP | 04-182632 | A | 6/1992 |
| JP | 2001-319502 | A | 11/2001 |
| JP | 2003-287812 | A | 10/2003 |
| JP | 2008-276962 | A | 11/2008 |

* cited by examiner

*Primary Examiner*—Anabel M Ton
(74) *Attorney, Agent, or Firm*—Rader, Fishman & Grauer PLLC

(57) ABSTRACT

A light source apparatus comprises reflection mirrors, first and second lamp holding sections, wherein the reflection mirrors are provided between the first and second lamp holding section, a reflection mirror support plate to which reflection mirrors are attached, a first lamp holding section support plate to which the first lamp holding section is attached, a second lamp holding section support plate to which the second lamp holding section is attached, a first fixing member which fixes the reflection mirror support plate and the first lamp holding section support plate to each other, a second fixing member which fixes the reflection mirror support plate and the second lamp holding section support plate to each other.

6 Claims, 6 Drawing Sheets

LIGHT SOURCE APPARATUS

CROSS-REFERENCES TO RELATED APPLICATION

The disclosure of Japanese Patent Application No. 2007-150532, filed Jun. 6, 2007, including its specification, claims and drawings, is incorporated herein by reference in its entirety.

TECHNICAL FIELD

Described herein is a light source apparatus, and especially, a light source apparatus used for a light source of a projector.

BACKGROUND

In Japanese Laid Patent No. 2001-319502, a light source apparatus which uses a xenon lamp as a light source of a projector is disclosed. As in Japanese Laid Patent No. 2001-319502, FIG. 6 shows a cross sectional view of a lamp of a conventional light source apparatus 100, taken along a longitudinal direction thereof, in which a short arc type xenon lamp is used. In the figure, xenon gas whose pressure becomes 2-8 MPa at time of lighting, is enclosed in a spherical bulb 111 of a short arc type xenon lamp 101, and a pair of electrodes 112 is arranged inside thereof. A pair of sealing portions 113 which hold the respective electrodes 112 is provided in both ends of the bulb 111, and mouthpieces 114 and 115 are provided in the respective sealing portions 113. The pair of electrodes 112 is connected with a power supply (not shown), and the xenon lamp 101 is turned on when rated lighting electric power of 2-7 kW is inputted therein. At time of lighting of the xenon lamp 101, since a distance between the electrodes 112 which face each other is short (close to each other), a diameter of an arc becomes short so as to become a small point light source.

One (114) of the pair of mouthpieces 114 and 115 which are arranged at the both ends of the xenon lamp 101 is held by a first lamp holding section 102, and on the other hand, the mouthpiece 115 is held by a second lamp holding section 103. Reflection mirrors 104 and 105 are arranged so that the bulb 111 of the xenon lamp 101 may be surrounded by and provided between the mouthpieces 114 and 115. The reflection mirrors 104 and 105 are provided so that focal points thereof and a focal point (point light source) of the xenon lamp 101 may be matched each other. The first lamp holding section 102, the second lamp holding section 103, and reflection mirrors 104 and 105 are supported on a support plate 106. The support plate 106 is installed in a projector (not shown).

SUMMARY

The xenon lamp 101 has internal pressure higher than atmospheric pressure by enclosing xenon gas in the xenon lamp 101. For this reason, a burst of the xenon lamp 101 will damage reflection mirrors 104 and 105. When the reflection mirrors 104 and/or 105 are damaged, the entire support plate 106 which supports the reflection mirrors 104 and 105 needs to be replaced. However, since the first lamp holding section 102 and the second lamp holding section 103 are supported on the support plate 106, the entire light source apparatus needs to be replaced. Thus, there is a problem that the labor on work became large. Furthermore, the damaged reflection mirrors 104 and 105 need to be replaced together with the first lamp holding section 102 and the second lamp holding section 103 which have not been damaged. Thus, there is a problem that it is not economical.

In view of the above problem, described herein is a light source apparatus in which only reflection mirrors can be replaced without replacing other components forming the light source apparatus when replacing the damaged reflection mirrors, so that labor of replacement may be reduced and economical efficiency in replacing parts may be improved.

In order to solve the above problem, the present light source apparatus is adopted. The light source apparatus comprises reflection mirrors; first and second lamp holding sections, wherein the reflection mirrors are provided between the first and second lamp holding section; a reflection mirror support plate to which reflection mirrors are attached; a first lamp holding section support plate to which the first lamp holding section is attached; a second lamp holding section support plate to which the second lamp holding section is attached; a first fixing member which fixes the reflection mirror support plate and the first lamp holding section support plate to each other; a second fixing member which fixes the reflection mirror support plate and the second lamp holding section support plate to each other, wherein an end face of the reflection mirror support plate and an end face of the first lamp holding section support plate are in contact with each other, and/or other end face of the reflection mirror support plate and an end face of the second lamp holding section support plate are in contact with each other.

Since only the reflection mirrors and the reflection mirror support plate which supports the reflection mirrors is replaced at time of replacement of reflection mirrors, a replacement operation can be easily carried out, compared with the case where the entire light source apparatus is replaced.

Moreover, since only the reflection mirror and the reflection mirror support plate which supports the mirrors is replaced, the cost can be reduced.

Moreover, positioning of the lamp in a direction perpendicular to the longitudinal direction of the lamp can be carried out with sufficient accuracy by the first fixing member and the second fixing member.

The light source apparatus may further include a first lamp holding section side positioning member which is disposed on the first lamp holding section support plate; a second lamp holding section side positioning member which is disposed on the second lamp holding section support plate; and an elastic member provided on a face of the first lamp holding section side positioning plate and/or the second lamp holding section side positioning plate, on which the reflection mirror support plate face. Therefore, positioning of the gravity direction of the light source apparatus to be installed can be performed with sufficient accuracy.

An elastic member may be provided on one end face or other end face of the reflection support plate, an end face of the first lamp holding section support plate or an end of the second lamp holding section support plate. Therefore, positioning of the lamp in the longitudinal direction or positioning of the lamp in the gravity direction of the light source apparatus to be installed can be performed with sufficient accuracy.

The elastic member may be attached to the first lamp holding section supporting plate and/or the second lamp holding member.

Moreover, described herein is a method of replacing a reflection mirror support plate of a light source apparatus, having damaged reflection mirrors. The method comprises the following steps of: putting one end face of the reflection mirror support plate and one end face of the first lamp holding section supporting plate together so as to be in contact with each other; putting other end face of the reflection mirror support plate and one end surface of the second lamp holding section supporting plate so as to be in contact with each other, wherein the reflection mirror support plate is inserted between the first lamp holding section supporting plate and the second lamp holding section supporting plate, and wherein a first positioning member and a first lamp holding section side positioning member are made in contact with each other by the insertion, and a second positioning member and a second lamp holding section side positioning member are made in contact with each other; fixing the first positioning member and the first lamp holding section side positioning member to each other by a first fixing members, whereby the first lamp holding section supporting plate and the reflection mirror support plate are fixed to each other, and fixing the second positioning member and the second lamp holding section side positioning member fixed to each other by the second fixing member, whereby the second lamp holding section supporting plate and the reflection mirror support plate are fixed to each other.

The method may further include removing first and second temporary fixing members from the light source apparatus before the step of putting one end face of the reflection mirror support plate and one end face of the first lamp holding section supporting plate together.

BRIEF DESCRIPTION OF THE DRAWINGS

Other features and advantages of the present light source apparatus will be apparent from the ensuing description, taken in conjunction with the accompanying drawings, in which.

DESCRIPTION

A first embodiment will be explained, referring to FIGS. 1 to 3.

Figure 1:
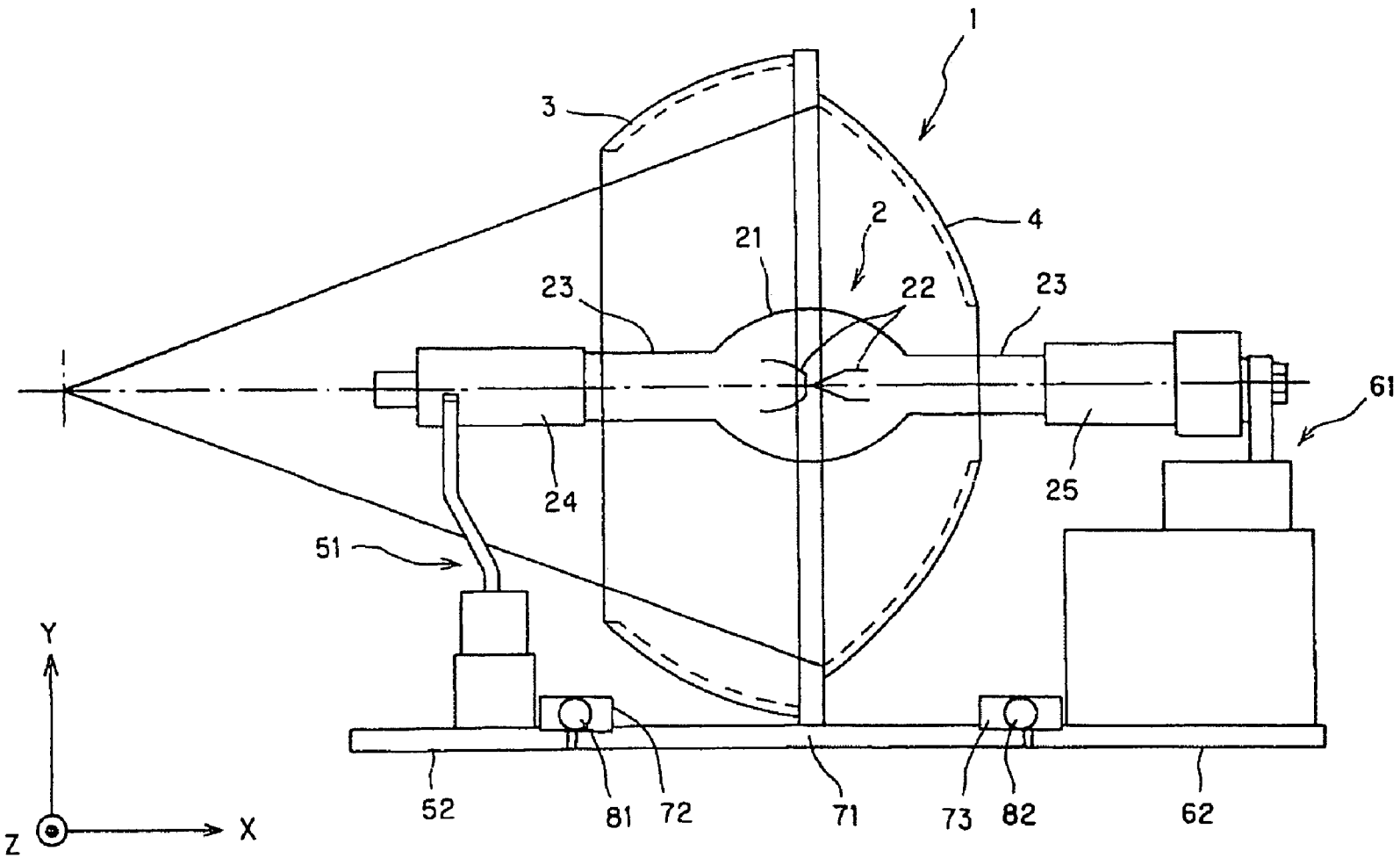
FIG. 1 is a front cross sectional view of a lamp of a light source apparatus 1 according to an embodiment, taken along a longitudinal direction of the lamp.

FIG. 1 is a front cross sectional view of a lamp of a light source apparatus 1 according to the embodiment, taken along a longitudinal direction. FIG. 2 is a front cross sectional view of the light source apparatus 1 shown in FIG. 1, in which a reflection mirror support plate 71, a first lamp holding section supporting plate 52 and a second lamp holding supporting member 62 are separated from one another, and a xenon lamp 2 is omitted. FIG. 3 is a plan view of the light source apparatus shown in FIG. 2.

As shown in these figures, the light source apparatus 1 includes a short arc type xenon lamp 2 having a spherical bulb 21, a pair of electrodes 22 which face each other in the bulb 21, and a pair of sealing portions 23 in which the respective electrode 22 are buried in the bulb 21 at both ends thereof. Mouthpieces 24 and 25 are provided in the respective sealing portions 23. Reflection mirrors 3 and 4 are arranged so that the bulb 21 of the xenon lamp 2 may be surrounded by the reflection mirrors 3 and 4 and provided between the mouthpiece 24 and the mouthpiece 25. A first lamp holding section 51 holds the mouthpiece 24, and a first lamp holding section supporting plate 52 supports the first lamp holding section 51. A first lamp holding section side positioning member 53 is provided on the first lamp holding section supporting plate 52, and the first lamp holding section supporting plate 52 has an end surface 54. Screw holes 55 are formed in the first lamp holding section side positioning member 53. A second lamp holding section 61 holds the mouthpiece 25 at the other side thereof. A second lamp holding section supporting plate 62 supports the second lamp holding section 61. The second lamp holding section side positioning member 63 is provided on the second lamp holding section supporting plate 62. The second lamp holding section supporting plate 62 has an end surface 64. Screw holes 65 are formed in the second lamp holding section side positioning member 63. The reflection mirror support plate 71 supports the reflection mirrors 3 and 4. The first positioning member 72 is provided on the reflection mirror support plate 71 in the reflection mirror 3 side. The second positioning member 73 is provided on the reflection mirror support plate 71 in the reflection mirror 4 side. The reflection mirror support plate 71 has one end face 74 and the other end face 75. Screw holes 76 are formed in the reflection mirror support plate 71. A first fixing member 81 such as a screw is provided in the first positioning member 72. A second fixing member such as a screw is provided in the second positioning member 73. First temporary fixing members 83 such as screws are used at time of transportation. Second temporary fixing members 84 are also used at time of transportation.

Figure 2:
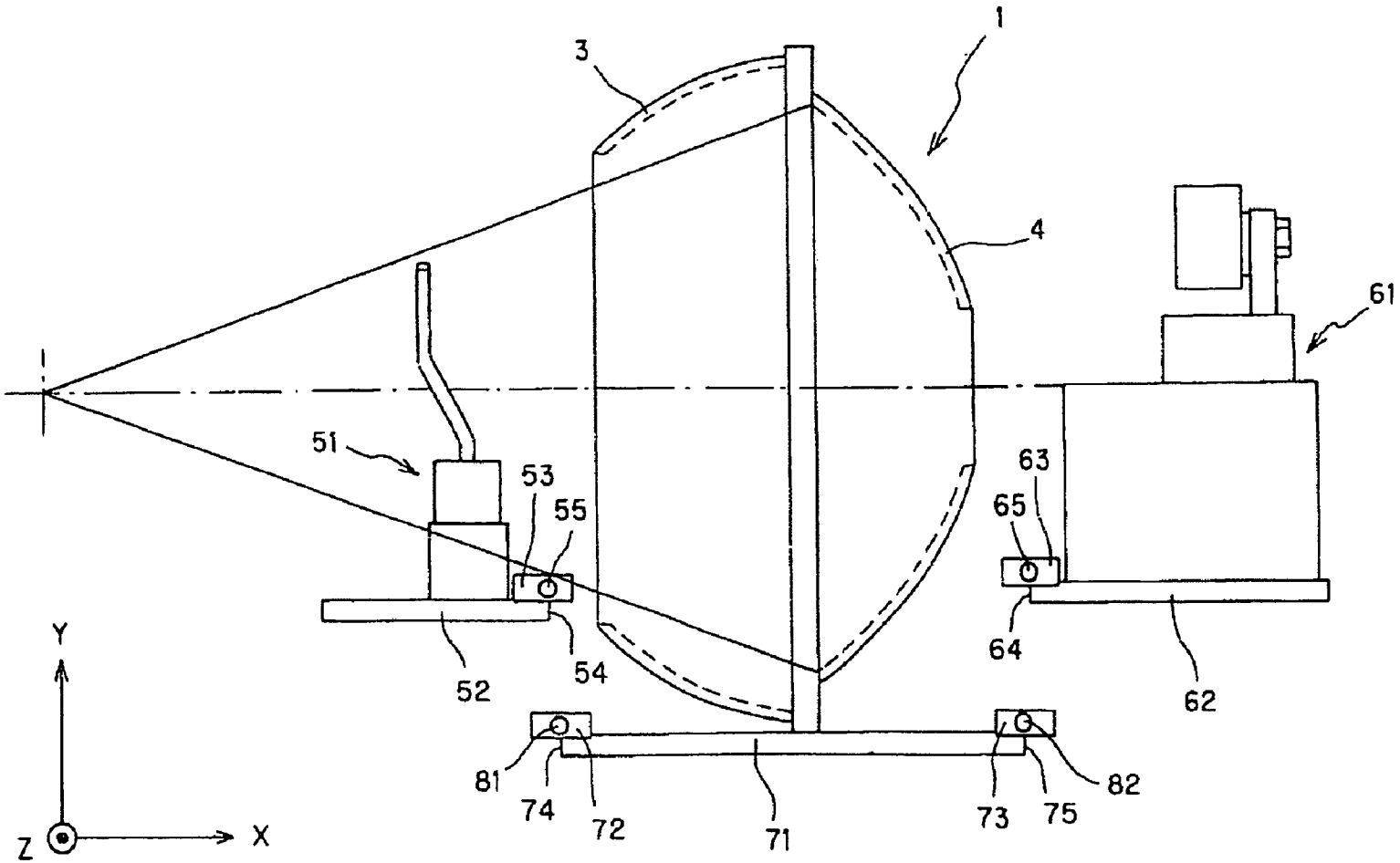
FIG. 2 is a front cross sectional view of the light source apparatus 1 shown in FIG. 1, in which a reflection mirror support plate 71, a first lamp holding section supporting plate 52 and a second lamp holding supporting member 62 are separated from one another.
Figure 3:
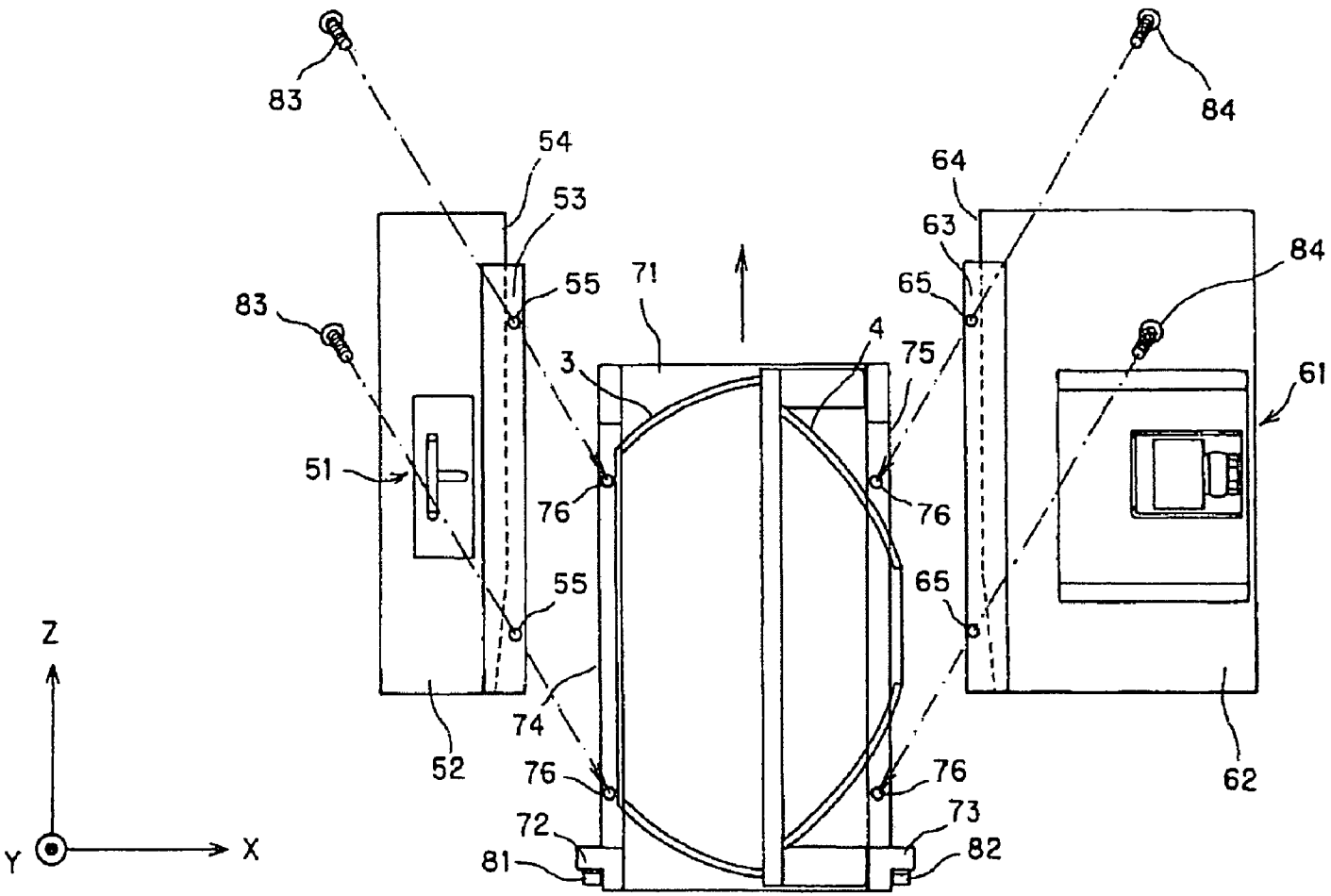
FIG. 3 is a plan view of the light source apparatus shown in FIG. 2, in which, for convenience of explanation, one end face 74 of a reflection mirror support plate 71 and an end face of a first lamp holding section supporting plate 52 are apart from each other, and the other end face 75 of the reflection mirror support plate 71 and an end surfaces 64 of a second lamp holding section supporting plate 62 are apart from each other.

The light source apparatus 1 according to an embodiment can be disassembled so that the reflection mirror support plate 71, the first lamp holding section supporting plate 52, and the second lamp holding section supporting plate 62 may be separately removed, as shown in FIGS. 1-3. In FIG. 1, the xenon lamp 2 is installed in a state where the first lamp holding section supporting plate 52 and the reflection mirror support plate 71 which supports the reflection mirrors 3 and 4 respectively are joined by the first temporary fixing members 81, and where the reflection mirror support plate 71 and the second lamp holding section supporting plate 62 are joined by the second temporary fixing member 82. In addition, xenon gas is enclosed inside the bulb 21 of the xenon lamp 2 so that the gas pressure at time of lamp lighting may be set to 2-8 MPa. The pair of electrodes 22 is connected with a power supply (not shown), and rated lighting electric power of 2-7 kW is inputted thereto so that the xenon lamp 2 is turned on. At the time of lighting of the xenon lamp 2, since the pair of electrodes 22 which face each other has a short distance between electrodes 22 (close to each other), the diameter of an arc is small so that a point light source becomes small. In addition, as shown in FIG. 1, a direction of a central axis of the pair of electrodes 22 of the xenon lamp 2 is shown as an X axial direction, a direction which is perpendicular to the electrodes 22 and in which the first lamp support member 5 which supports the xenon lamp 2 extends, is shown as a Y axial direction, and a direction which is perpendicular to the X axial direction and the Y axial direction is shown as a Z axial direction.

FIGS. 2 and 3 shows a state where after reflection mirrors 3 and 4 etc. are damaged, the reflection mirror support plate 71 on which reflection mirrors 3 and 4 are newly installed is about to be joined with the first lamp holding section supporting plate 52 which supports the first lamp holding section 51 which was not broken, and the second lamp holding section supporting plate 62 which supports the second lamp holding section 61. As shown in these figures, the first lamp holding section side positioning member 53 is provided at an end portion of the first lamp holding section supporting plate 52, which is located in the reflection mirror support plate 71 side of the plate 52. The second lamp holding section side positioning member 63 is provided at an end portion of the second lamp holding section supporting plate 62 which is located in the reflection mirror support plate 71 side of the plate 62. At the first lamp holding section side positioning member 53 and an end portion of the reflection mirror support plate 71 which is located in the first lamp holding section supporting plate 52 side of the support plate 71, screw stop holes 55 and 76 for the first temporary fixing members 83 are provided. Screw stop Holes 65 and 76 for the second temporary holding members 84 are respectively provided in the second lamp holding section side positioning member 63 and an end portion of the reflection mirror support plate 71 which is located in the second lamp holding section supporting plate 62 side of the support plate 71. At time of conveyance of the light source apparatus 1, the first lamp holding section supporting plate 52 and the reflection mirror support plate 71 are temporarily fixed by the first temporary fixing members 83, and the second lamp holding section supporting plate 62 and the reflection mirror support plate 71 are temporarily fixed by the second temporary fixing members 84, whereby the light source apparatus 1 except the xenon lamp 1 is conveyed as a unit.

In assembly of the separated parts of the light source apparatus 1, the first and second temporary fixing members 83 and 84 for temporarily holding the parts are removed, and as shown in FIG. 3, the one end face 74 of the reflection mirror support plate 71 and the end face 54 of the first lamp holding section supporting plate 52 are made in contact with each other by sliding the reflection mirror support plate 71 in between the support plates 52 and 62. However, for convenience of explanation, in FIG. 3, the one end face 74 of the reflection mirror support plate 71 and the end surface of the first lamp holding section supporting plate 52 are apart, and the other end face 75 of the reflection mirror support plate 71 and the end surfaces 64 of the second lamp holding section supporting plate 62 are apart.

Moreover, at the same time, the other end face 75 of the reflection mirror support plate 71 and the end surface 64 of the second lamp holding section supporting plate 62 are in contact with each other by sliding the support plate 71, so that the reflection mirror support plate 71 is inserted between the first lamp holding section supporting plate 52 and the second lamp holding section supporting plate 62. The first positioning member 72 which is located in the reflection mirror side of the support plate 71 and the first lamp holding section side positioning member 53 are made in contact with each other by the insertion, and then the second positioning member 73 which is located in the reflection mirror side and the second lamp holding section side positioning member 63 are made in contact with each other.

Next, the end surface 54 of the first lamp holding section supporting plate 52 and the one end face 74 of the reflection mirror support plate 71 are arranged so as to be in contact with each other, and the end surface 64 of the second lamp holding section supporting plate 62 and the other end face 75 of the reflection mirror support plate 71 are arranged so as to be in contact with each other, so that the focal point of the xenon lamp (not shown) held by the first lamp holding section 51 and the second lamp holding section 61 is in agreement with focal points of the reflection mirrors 3 and 4 supported on the reflection mirror support plate 71, Next, the first positioning member 72 which is located in the reflection mirror 3 side of the support plate 71 and the first lamp holding section side positioning member 53 are fixed by the first fixing members 81, whereby the first lamp holding section supporting plate 52 and the reflection mirror support plate 71 are fixed. The second positioning member 73 which is located in the reflection mirror 4 side of the support plate 71 and the second lamp maintenance section side positioning member 63 are fixed by the second fixing member 82, whereby the second lamp holding section supporting plate 62 and the reflection mirror support plate 71 are fixed. That is, the first lamp holding section supporting plate 52, the reflection mirror support plate 71, and the second lamp holding section supporting plate 62 are formed as a united light source apparatus so that the focal point of the xenon lamp (not shown) held by the first lamp holding section 51 and the second lamp holding section 61 is in agreement with focal points of the reflection mirrors 3 and 4 supported on the reflection mirror support plate 71. Then, the first lamp holding section supporting plate 52 and the second lamp holding section supporting plate 62 of the light source apparatus 1, are fixed to the projector (not shown). For this reason, as a result, the reflection mirror support plate 71 fixed to the first lamp holding section supporting plate 52 and the second lamp holding section supporting plate 62 is also fixed to the projector (not shown).

When the xenon lamp 2 is blown out so that the reflection mirrors 3 and 4 are damaged, the first fixing member 81 and the second fixing member 82 are removed, so that only the reflection mirror support plate 71 which supports the damaged reflection mirrors 3 and 4 is removed while the first lamp holding section supporting plate 52 and the second lamp holding section supporting plate 62 are fixed to the projector. The reflection mirror support plate 71 which supports the reflection mirrors 3 and 4 to be replaced is inserted between the first lamp holding section supporting plate 52 fixed to the projector, and the second lamp holding section supporting plate 62, by sliding the reflection mirror support plate 71 in between the supporting plates 52 and 62, so as to be in contact with one another. When the reflection mirror support plate 71 is inserted therein, the one end face 74 of the reflection mirror support plate 71 and the end surface 54 of the first lamp holding section supporting plate 52 are in contact with each other, and the other end face 75 of the reflection mirror support plate 71 and the end surface 64 of the second lamp holding section supporting plate 62 are in contact with each other, so that positioning thereof in the X axial direction is secured.

Moreover, while the first positioning member 72 which is located in the reflection mirror 3 side of the support plate 71 and the first lamp holding section side positioning member 53 are in contact with each other, the second positioning member 73 which is located in the reflection mirror 4 side of the support plate 71 and the second lamp holding section side positioning member 63 are in contact with each other, so that positioning thereof in the Z axial direction can be secured. Positioning of the support plate 71 in the Y axial direction can be realized with the self-weight of the reflection mirror support plate 71.

According to the embodiment, the reflection mirror support plate 71 which supports the reflection mirrors 3 and 4 can be replaced by release and fixation of the first fixing member 81 and the second fixing member 82. Even if the reflection mirror support plate 71 is replaced, positioning of the support plate 71 in the X axial direction can be performed by the one end face 74, the other end face 75 of the reflection mirror support plate 71, the end surface 54 of the first lamp holding section supporting plate 52, and the end surface 64 of the second lamp holding section supporting plate 62, and further the positioning of the support plate 71 in the Y axial direction can be performed by the self-weight of the reflection mirror support plate 71. While the first positioning member 72 which is located in the reflection mirror 3 side of the support plate 71 and the first lamp holding section side positioning member 53 are in contact with each other, the second positioning member 73 which is located in the reflection mirror 4 side of the support plate 71 and the second lamp holding section side positioning member 63 are in contact with each other, so that the positioning of the support plate 71 in the Z axial direction can be realized. For this reason, even if the reflection mirror support plate 71 is replaced, the focal point of the xenon lamp (not shown) and the focal points of reflection mirrors 3 and 4 can be made in agreement with each other. Since while the support plate of light source apparatus can be separated into three parts, that is, the first lamp holding section supporting plate 52, the reflection mirror support plate 71, and the second lamp holding section supporting plate 62, only the reflection mirror support plate 71 which supports the reflection mirrors 3 and 4 can be replaced by providing the first fixing members 81 and the second fixing members 82. Therefore, it is possible to reduce the cost of parts for replacement, compared with the case where the entire light source apparatus is replaced.

Figure 4:
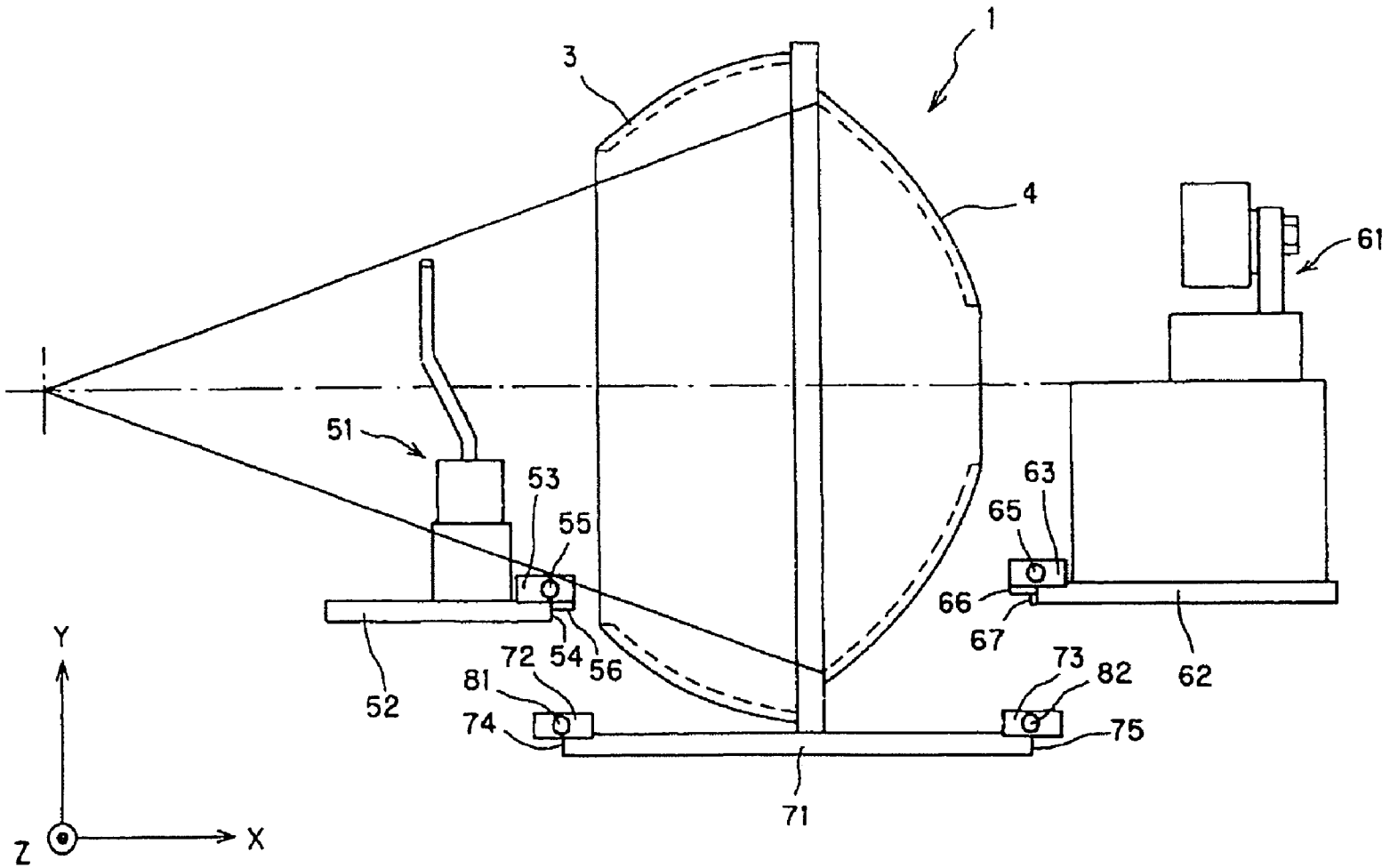
FIG. 4 is a front cross sectional view of a light source apparatus according to a second embodiment, in which the light source apparatus 1 is taken apart into the reflection mirror support plate 71, the first lamp holding section supporting plate 52, and the second lamp holding section supporting plate 62.
Figure 5:
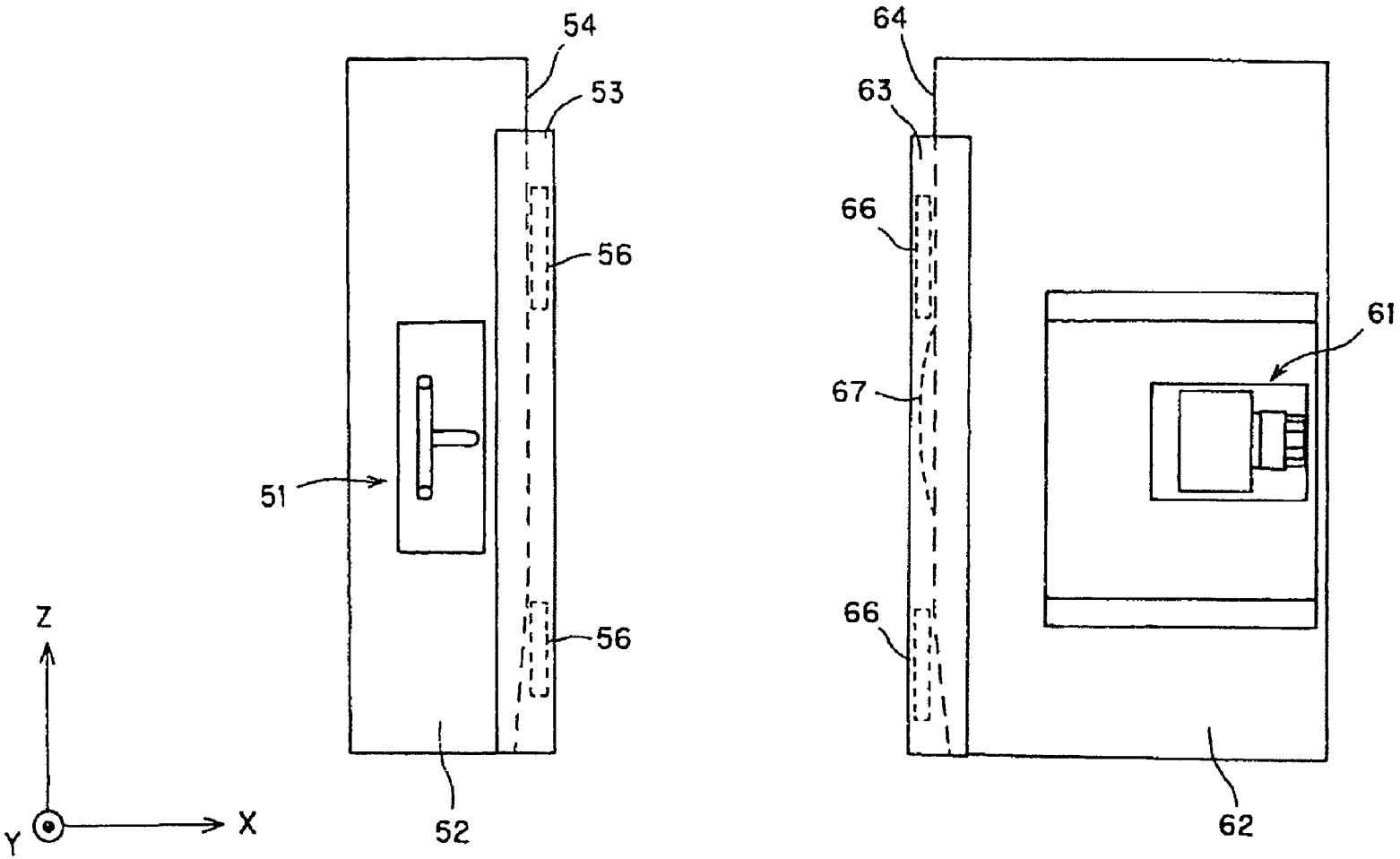
FIG. 5 is a plan view of a light source apparatus in which the reflection mirrors 3 and 4 and the reflection mirror support plate 71 which are shown in FIG. 4, are omitted.
Figure 6:
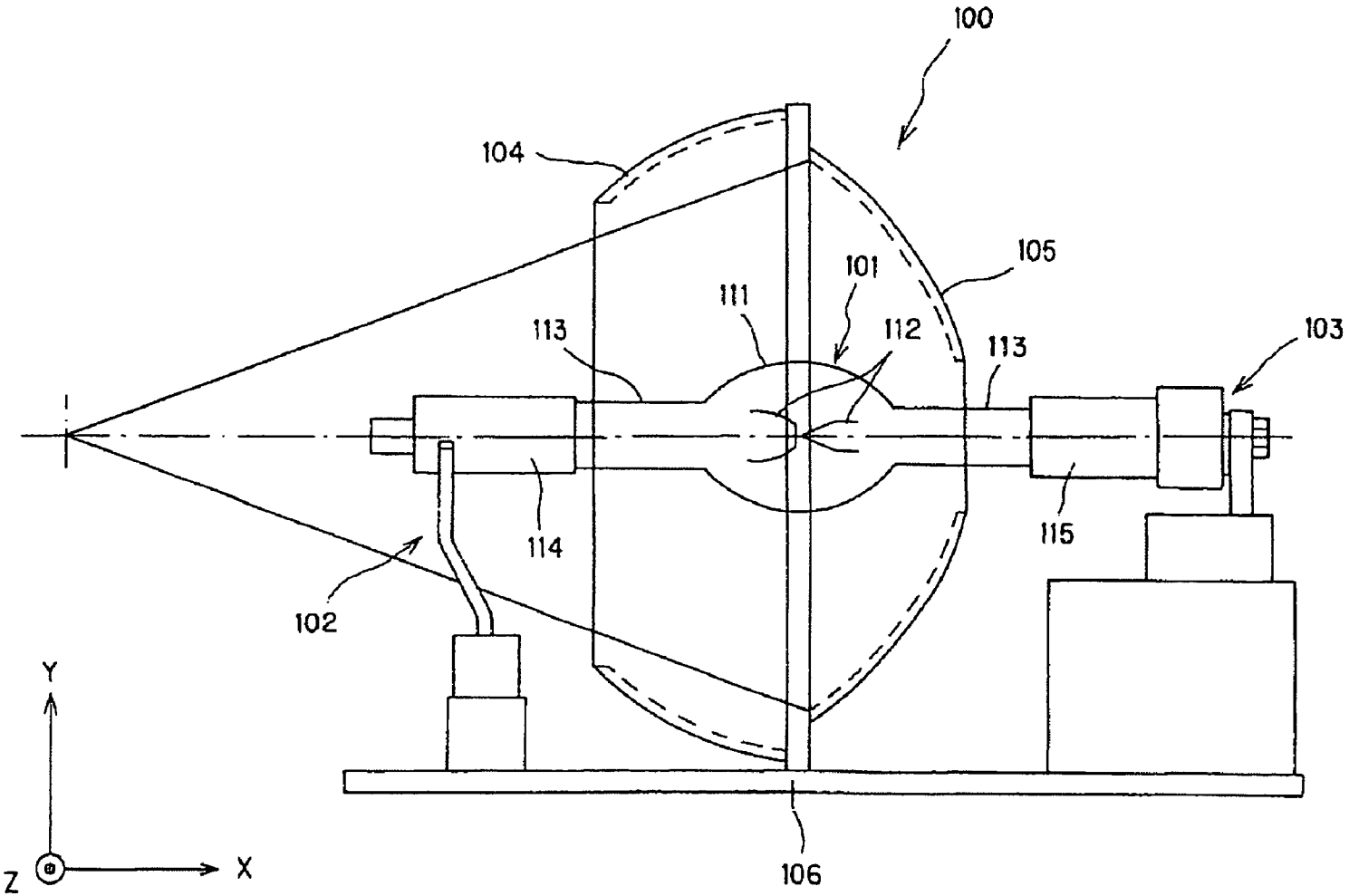
FIG. 6 is a cross sectional view of a lamp of a conventional light source apparatus 100, taken along a longitudinal direction thereof.

A second embodiment of a light source apparatus is explained, referring to FIGS. 4 and 5.

FIG. 4 is a front cross sectional view of the light source apparatus according to the embodiment, in which the light source apparatus 1 is taken apart into a reflection mirror support plate 71, a first lamp holding section supporting plate 52, and a second lamp holding section supporting plate 62. FIG. 5 is a plan view of the light source apparatus in which the reflection mirrors 3 and 4 and the reflection mirror support plate 71 which are shown in FIG. 4, are omitted.

In these figures, elastic members 56 such as flat springs are provided on a face on which the first lamp holding section side positioning member 53 is slidably in contact with the reflection mirror support plate 71. Elastic members 66 such as flat springs are provided on a face on which the second lamp holding section side positioning member 63 is in contact with the reflection mirror support plate 71. An elastic member 67 such as a flat spring is provided on an end surface 64 on which the second lamp holding section supporting plate 62 is in contact with the reflection mirror support plate 71. In addition, instead of providing the elastic member 67 on the end surface 64 on which the second lamp holding section supporting plate 62 is slidably in contact with the reflection mirror support plate 71, the elastic member may be provided on the one end face 74, the other end face 75 of the reflection mirror support plate 71, or the end surface 54 on which the first lamp holding section supporting plate 52 is slidably in contact with the reflection mirror support plate 71. In these figures, explanation of the other structures corresponding to the reference numerals shown in FIGS. 2 and 3 is omitted.

According to the embodiments, by providing the elastic members 56 and 66, it is possible to securely position the reflection support plate 71 in the Y axial direction. In addition, by providing the elastic member 67, it is possible to press the one end face 74 of the reflection mirror support plate 71 onto the end face 54 of the first lamp holding section support plate 52 whereby it is possible to position it in the X axial direction.

The preceding description has been presented only to illustrate and describe exemplary embodiments of the light source apparatus according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A light source apparatus comprising:

reflection mirrors;

first and second lamp holding sections, wherein the reflection mirrors are provided between the first and second lamp holding section;

a reflection mirror support plate to which reflection mirrors are attached;

a first lamp holding section support plate to which the first lamp holding section is attached;

a second lamp holding section support plate to which the second lamp holding section is attached;

a first fixing member which fixes the reflection mirror support plate and the first lamp holding section support plate to each other;

a second fixing member which fixes the reflection mirror support plate and the second lamp holding section support plate to each other, wherein (1) one end face of the reflection mirror support plate and an end face of the first lamp holding section support plate are in contact with each other, (2) the other end face of the reflection mirror support plate and an end face of the second lamp holding section support plate are in contact with each other, or (3) the one end face of the reflection mirror support plate and the end face of the first lamp holding section support plate are in contact with each other and the other end face of the reflection mirror support plate and the end face of the second lamp holding section support plate are in contact with each other;

the reflection mirror support plate, the first lamp holding section support plate and the second lamp holding section support plate are arranged on a single plane.

2. The light source apparatus according to claim 1, further including a first lamp holding section side positioning member which is disposed on the first lamp holding section support plate; a second lamp holding section side positioning member which is disposed on the second lamp holding section support plate; and an elastic member provided on a face of the first lamp holding section side positioning plate or the second lamp holding section side positioning plate, on which the reflection mirror support plate face.

3. The light source apparatus according to claim 1, wherein an elastic member is provided on one end face or other end face of the reflection support plate, an end face of the first lamp holding section support plate or an end of the second lamp holding section support plate.

4. A method of replacing a reflection mirror support plate of a light source apparatus, having damaged reflection mirrors, the method comprising the following steps of:

putting one end face of the reflection mirror support plate and one end face of the first lamp holding section supporting plate together so as to be in contact with each other;

putting other end face of the reflection mirror support plate and one end surface of the second lamp holding section supporting plate so as to be in contact with each other, wherein the reflection mirror support plate is inserted between the first lamp holding section supporting plate and the second lamp holding section supporting plate, and wherein a first positioning member and a first lamp holding section side positioning member are made in contact with each other by the insertion, and a second positioning member and a second lamp holding section side positioning member are made in contact with each other;

fixing the first positioning member and the first lamp holding section side positioning member to each other by a first fixing member, whereby the first lamp holding section supporting plate and the reflection mirror support plate are fixed to each other; and fixing the second positioning member and the second lamp holding section side positioning member fixed to each other by a second fixing member, whereby the second lamp holding section supporting plate and the reflection mirror support plate are fixed to each other.

5. The method according to claim 4, further including removing first and second temporary fixing members from the light source apparatus before the step of putting one end face of the reflection mirror support plate and one end face of the first lamp holding section supporting plate together.

6. The light source apparatus according to claim 1, further including a first lamp holding section side positioning member which is disposed on the first lamp holding section support plate; a second lamp holding section side positioning member which is disposed on the second lamp holding section support plate; and an elastic member provided on a face of the first lamp holding section side positioning plate and the second lamp holding section side positioning plate, on which the reflection mirror support plate face.

* * * * *